US010931013B2

(12) United States Patent
Cooper et al.

(10) Patent No.: US 10,931,013 B2
(45) Date of Patent: Feb. 23, 2021

(54) ELECTRONIC DEVICE HAVING DUAL-FREQUENCY ULTRA-WIDEBAND ANTENNAS

(71) Applicant: Apple Inc., Cupertino, CA (US)

(72) Inventors: Aaron J. Cooper, San Jose, CA (US); Amin Tayebi, San Jose, CA (US); Carlo di Nallo, Belmont, CA (US); Zheyu Wang, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 12 days.

(21) Appl. No.: 16/277,808

(22) Filed: Feb. 15, 2019

(65) Prior Publication Data

US 2020/0266539 A1 Aug. 20, 2020

(51) Int. Cl.

| | |
|---|---|
| ***H01Q 1/24*** | (2006.01) |
| ***H01Q 5/25*** | (2015.01) |
| ***H01Q 21/28*** | (2006.01) |
| ***H01Q 1/08*** | (2006.01) |

(52) U.S. Cl.

CPC ..... *H01Q 5/25* (2015.01); *H01Q 1/085* (2013.01); *H01Q 1/241* (2013.01); *H01Q 21/28* (2013.01)

(58) Field of Classification Search

None

See application file for complete search history.

(56) References Cited

U.S. PATENT DOCUMENTS 6,268,831 B1 * 7/2001 Sanford ..... H01Q 1/243 343/700 MS
6,650,298 B2 11/2003 Abbasi et al.
7,880,684 B2 2/2011 Schantz
8,130,162 B2 3/2012 Kildal
8,725,095 B2 * 5/2014 Li ..... H01Q 9/0421 455/129
8,970,443 B2 3/2015 Ridgeway
9,118,109 B2 8/2015 Oh et al.
9,979,086 B2 5/2018 Ng et al.
10,084,240 B2 9/2018 Shamblin et al.
(Continued)

FOREIGN PATENT DOCUMENTS

WO 2019010051 A1 1/2019

OTHER PUBLICATIONS

Cooper et al. U.S. Appl. No. 16/035,325, filed Jul. 13, 2018.

*Primary Examiner* — Anh Q Tran
(74) *Attorney, Agent, or Firm* — Treyz Law Group, P.C.; Michael H. Lyons; Tianyi He

(57) ABSTRACT

An electronic device may be provided with antennas for receiving signals in first and second ultra-wideband communications bands. The antennas may include a resonating element formed from conductive traces on a dielectric substrate. The substrate may be mounted to an underlying flexible printed circuit. A fence of conductive vias may extend from the resonating element, through the substrate and the flexible printed circuit, to a ground plane on the flexible printed circuit. The fence may form a return path for the antenna. A shielding ring may be formed on the substrate. Additional fences of vias may couple the shielding ring to the ground plane. If desired, the resonating element may include a patch that is not shorted to the ground plane. The fences of vias, the conductive traces, and the ground plane may form a continuous antenna cavity for the resonating element.

19 Claims, 13 Drawing Sheets

(56) References Cited

U.S. PATENT DOCUMENTS

| | | | | |
|---|---|---|---|---|
| 2003/0231134 | A1* | 12/2003 | Yarasi | H01Q 9/0421 343/700 MS |
| 2007/0262906 | A1 | 11/2007 | Haim et al. | |
| 2011/0050509 | A1 | 3/2011 | Ayala Vazquez et al. | |
| 2013/0278467 | A1* | 10/2013 | Dassano | H01Q 9/0414 343/700 MS |
| 2018/0145420 | A1 | 5/2018 | Kushta | |
| 2019/0097317 | A1 | 3/2019 | Di Nallo et al. | |
| 2019/0115654 | A1* | 4/2019 | Huang | H01Q 5/50 |

* cited by examiner

ELECTRONIC DEVICE HAVING DUAL-FREQUENCY ULTRA-WIDEBAND ANTENNAS

BACKGROUND

This relates to electronic devices and, more particularly, to electronic devices with wireless communications circuitry.

Electronic devices often include wireless communications circuitry. For example, cellular telephones, computers, and other devices often contain antennas and wireless transceivers for supporting wireless communications. Some electronic devices perform location detection operations to detect the location of an external device based on an angle of arrival of signals received from the external device (using multiple antennas).

To satisfy consumer demand for small form factor wireless devices, manufacturers are continually striving to implement wireless communications circuitry such as antenna components for performing location detection operations using compact structures. At the same time, there is a desire for wireless devices to cover a growing number of frequency bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over the desired range of operating frequencies.

It would therefore be desirable to be able to provide improved wireless communications circuitry for wireless electronic devices.

SUMMARY

An electronic device may be provided with wireless circuitry and control circuitry. The wireless circuitry may include antennas that are used to determine the position and orientation of the electronic device relative to external wireless equipment. The control circuitry may determine the position and orientation of the electronic device relative to the external wireless equipment at least in part by measuring the angle of arrival of radio-frequency signals from the external wireless equipment. The radio-frequency signals may be received in at least first and second ultra-wideband communications bands.

In one suitable arrangement, the antennas may include dual-band planar inverted-F antennas. Each antenna may include an antenna resonating element with a low band arm and a high band arm formed from conductive traces on a dielectric substrate. The high band arm may cover a first ultra-wideband communications band such as an 8.0 GHz ultra-wideband communications band. The low band arm may cover a second ultra-wideband communications band such as a 6.5 GHz ultra-wideband communications band.

The dielectric substrate may be a flexible printed circuit substrate formed from polyimide, liquid crystal polymer, or other materials. The dielectric substrate may be surface-mounted to an underlying flexible printed circuit. The antenna may include a first positive antenna feed terminal on the low band arm and a second positive antenna feed terminal on the high band arm. A fence of conductive vias may extend from the antenna resonating element, through the dielectric substrate and the flexible printed circuit, to a ground plane on the flexible printed circuit. The fence of conductive vias may form a return path for the antenna and may separate the low band arm from the high band arm.

A grounded shielding ring may be formed on the dielectric substrate. Additional fences of conductive vias may couple the grounded shielding ring to the ground plane through the dielectric substrate and the flexible printed circuit. The antenna may be fed using a stripline transmission line. The stripline may have a signal conductor that is coupled to the first and second positive antenna feed terminals using conductive vias extending through the dielectric substrate and the flexible printed circuit. The dielectric substrate and the flexible printed circuit may form an antenna cavity for the antenna resonating element.

In another suitable arrangement, the antennas may include dual-band patch antennas. In this scenario, the antenna may include a patch element formed from conductive traces on the dielectric substrate mounted to the flexible printed circuit. The dielectric substrate may be formed from ceramic when the antenna is implemented as a dual-band patch antenna. The patch element may have first opposing sides that configure the antenna to radiate in the 8.0 GHz ultra-wideband communications band and second opposing sides that configure the antenna to radiate in the 6.5 GHz ultra-wideband communications band. The fences of conductive vias coupled to the grounded shielding ring, the patch element, and the ground plane may form an antenna cavity for the patch element. The antenna cavity may include the dielectric substrate and a portion of the flexible printed circuit extending from the dielectric substrate to the ground plane.

DETAILED DESCRIPTION

Figure 1:
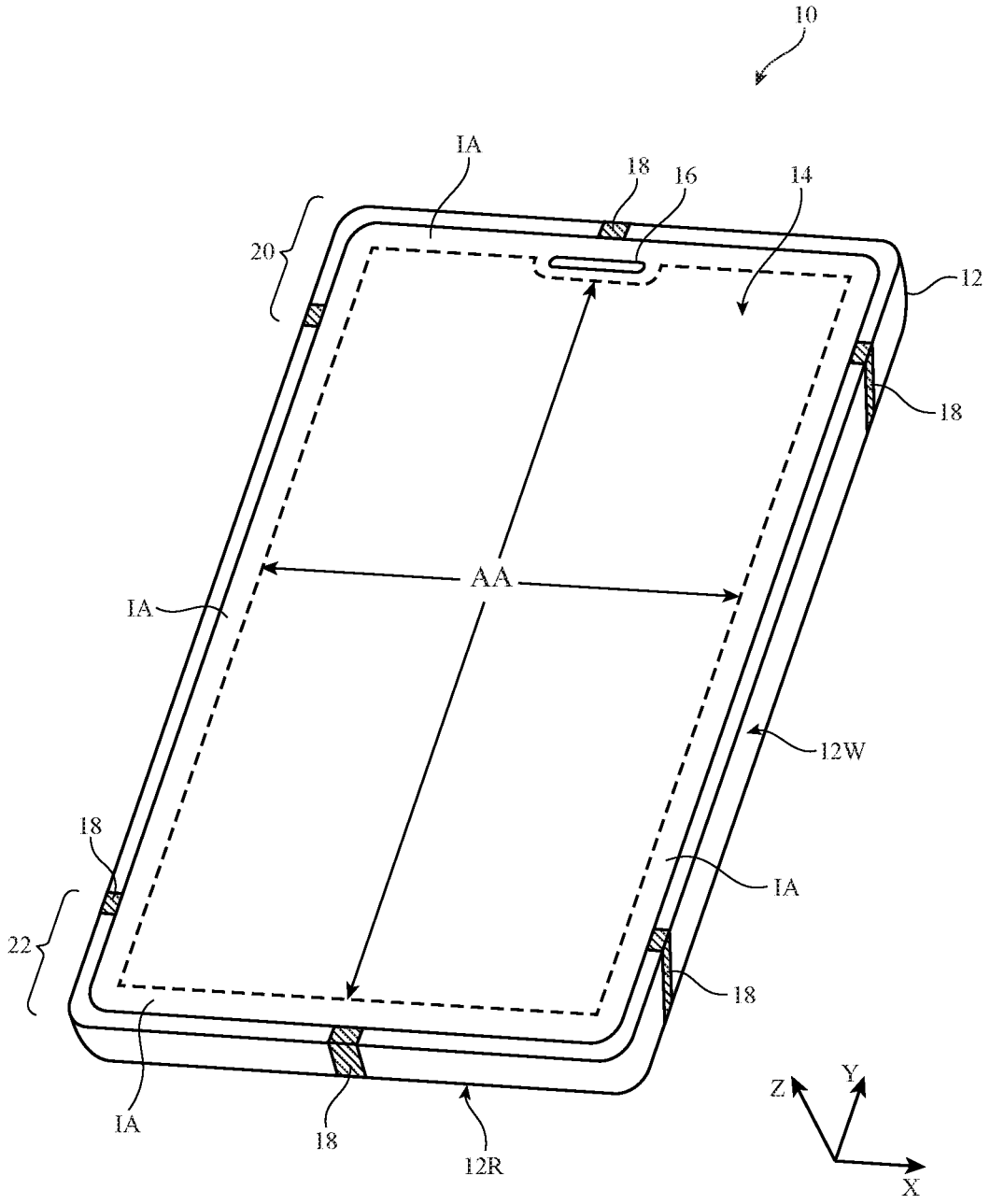
FIG. 1 is a perspective view of an illustrative electronic device in accordance with some embodiments.

Electronic devices such as electronic device 10 of FIG. 1 may be provided with wireless communications circuitry. The wireless communications circuitry may be used to support wireless communications in multiple wireless communications bands. Communications bands (sometimes referred to herein as frequency bands) handled by the wireless communications circuitry can include satellite navigation system communications bands, cellular telephone communications bands, wireless local area network communications bands, near-field communications bands, ultra-wideband communications bands, or other wireless communications bands.

The wireless communications circuitry may include one or more antennas. The antennas of the wireless communications circuitry can include loop antennas, inverted-F antennas, strip antennas, planar inverted-F antennas, patch antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The conductive housing structures may include peripheral structures such as peripheral conductive structures that run around the periphery of the electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Peripheral structures 12W and conductive portions of rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding lip that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

Rear housing wall 12R may lie in a plane that is parallel to display 14. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide peripheral conductive housing structures 12W and/or conductive portions of rear housing wall 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 16 or a microphone port. Openings may be formed in housing 12 to form communications ports (e.g., an audio jack port, a digital data port, etc.) and/or audio ports for audio components such as a speaker and/or a microphone if desired.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of peripheral conductive structures 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 22 and 20 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 22 and 20. If desired, the ground plane that is under active area AA of display 14 and/or other metal structures in device 10 may have portions that extend into parts of the ends of device 10 (e.g., the ground may extend towards the dielectric-filled openings in regions 22 and 20), thereby narrowing the slots in regions 22 and 20.

In general, device 10 may include any suitable number of antennas (e.g., one or more, two or more, three or more, four or more, etc.). The antennas in device 10 may be located at opposing first and second ends of an elongated device housing (e.g., ends at regions 22 and 20 of device 10 of FIG.

1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. There may be, for example, two peripheral conductive segments in peripheral conductive housing structures 12W (e.g., in an arrangement with two gaps 18), three peripheral conductive segments (e.g., in an arrangement with three gaps 18), four peripheral conductive segments (e.g., in an arrangement with four gaps 18), six peripheral conductive segments (e.g., in an arrangement with six gaps 18), etc. The segments of peripheral conductive housing structures 12W that are formed in this way may form parts of antennas in device 10 if desired.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 12W and may form antenna slots, gaps 18, and other structures in device 10. Polymer or other dielectric may fill these grooves and other housing openings. In some situations, housing openings that form antenna slots and other structure may be filled with a dielectric such as air.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area behind display 14 that is available for antennas within device 10. For example, active area AA of display 14 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency bandwidth.

In a typical scenario, device 10 may have one or more upper antennas and one or more lower antennas (as an example). An upper antenna may, for example, be formed at the upper end of device 10 in region 20. A lower antenna may, for example, be formed at the lower end of device 10 in region 22. Additional antennas may be formed along the edges of housing 12 extending between regions 20 and 22 if desired. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, ultra-wideband communications, etc.

Figure 2:
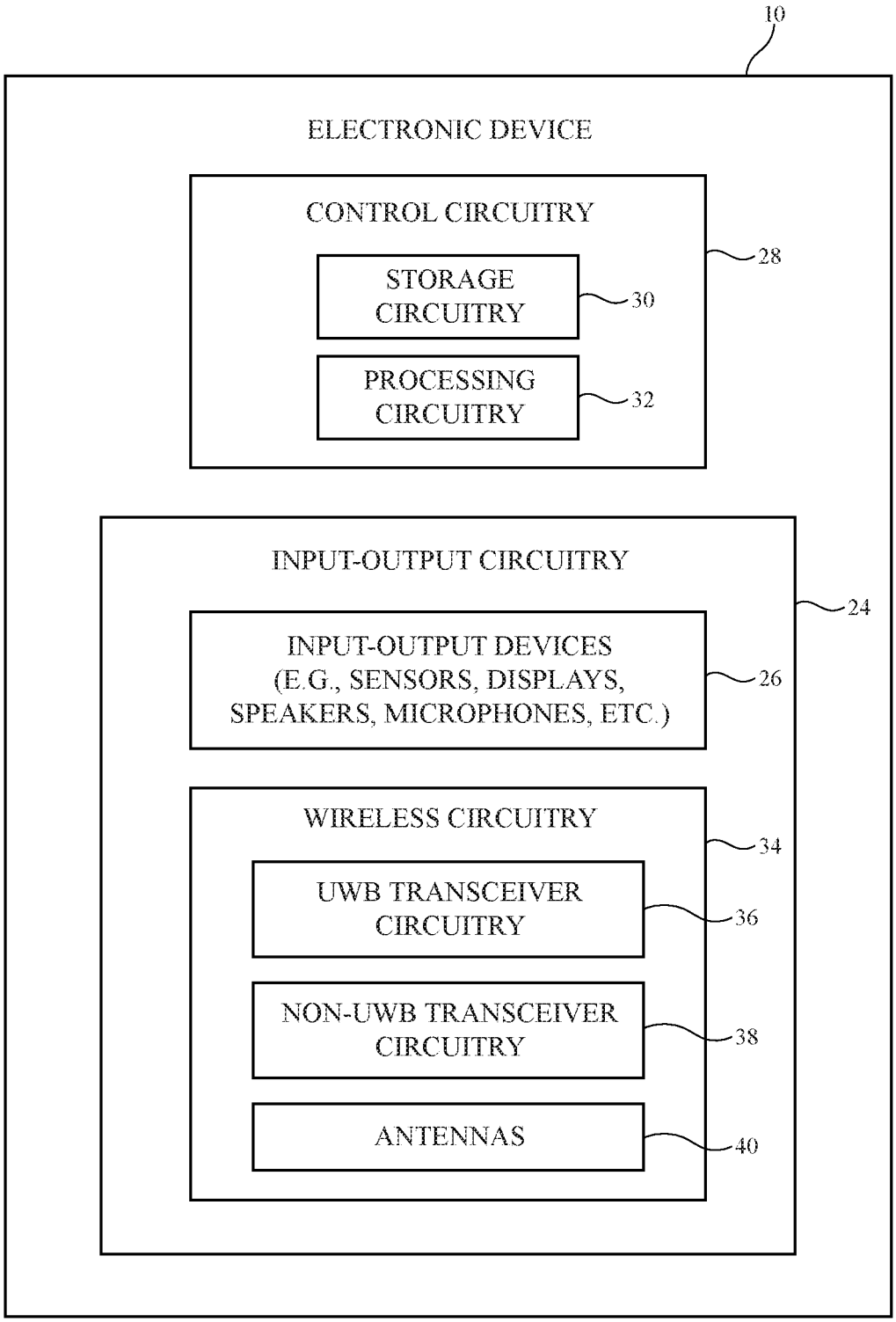
FIG. 2 is a schematic diagram of illustrative circuitry in an electronic device in accordance with some embodiments.

A schematic diagram of illustrative components that may be used in device 10 is shown in FIG. 2. As shown in FIG. 2, device 10 may include control circuitry 28. Control circuitry 28 may include storage such as storage circuitry 30. Storage circuitry 30 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 28 may include processing circuitry such as processing circuitry 32. Processing circuitry 32 may be used to control the operation of device 10. Processing circuitry 32 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 30 (e.g., storage circuitry 30 may include non-transitory (tangible) computer readable storage media that stores the software code). The software code may sometimes be referred to as program instructions, software, data, instructions, or code. Software code stored on storage circuitry 30 may be executed by processing circuitry 32.

Control circuitry 28 may be used to run software on device 10 such as external node location applications, satellite navigation applications, internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as Wi-Fi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols (e.g., global positioning system (GPS) protocols, global navigation satellite system (GLONASS) protocols, etc.), IEEE 802.15.4 ultra-wideband communications protocols or other ultra-wideband communications protocols, etc. Each communications protocol may be associated with a corresponding radio access technology (RAT) that specifies the physical connection methodology used in implementing the protocol.

Device 10 may include input-output circuitry 24. Input-output circuitry 24 may include input-output devices 26. Input-output devices 26 may be used to allow data to be supplied to device 10 and to allow data to be provided from device 10 to external devices. Input-output devices 26 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 24 may include wireless circuitry such as wireless circuitry 34 (sometimes referred to herein as wireless communications circuitry 34) for wirelessly conveying radio-frequency signals. To support wireless communications, wireless circuitry 34 may include radio-frequency (RF) transceiver circuitry formed from one or more integrated circuits, power amplifier circuitry, low-noise input amplifiers, passive RF components, one or more antennas such as antennas 40, transmission lines, and other circuitry for handling RF wireless signals. Wireless signals can also be sent using light (e.g., using infrared communications).

While control circuitry 28 is shown separately from wireless circuitry 34 in the example of FIG. 2 for the sake of clarity, wireless circuitry 34 may include processing circuitry that forms a part of processing circuitry 32 and/or storage circuitry that forms a part of storage circuitry 30 of control circuitry 28 (e.g., portions of control circuitry 28 may be implemented on wireless circuitry 34). As an example, control circuitry 28 (e.g., processing circuitry 32) may include baseband processor circuitry or other control components that form a part of wireless circuitry 34.

Wireless circuitry 34 may include radio-frequency transceiver circuitry for handling various radio-frequency communications bands. For example, wireless circuitry 34 may include ultra-wideband (UWB) transceiver circuitry 36 that supports communications using the IEEE 802.15.4 protocol and/or other ultra-wideband communications protocols. Ultra-wideband radio-frequency signals may be based on an impulse radio signaling scheme that uses band-limited data pulses. Ultra-wideband signals may have any desired bandwidths such as bandwidths between 499 MHz and 1331 MHz, bandwidths greater than 500 MHz, etc. The presence of lower frequencies in the baseband may sometimes allow ultra-wideband signals to penetrate through objects such as walls. In an IEEE 802.15.4 system, a pair of electronic devices may exchange wireless time stamped messages. Time stamps in the messages may be analyzed to determine the time of flight of the messages and thereby determine the distance (range) between the devices and/or an angle between the devices (e.g., an angle of arrival of incoming radio-frequency signals). Ultra-wideband transceiver circuitry 36 may operate (i.e., convey radio-frequency signals) in frequency bands such as an ultra-wideband communications band between about 5 GHz and about 8.3 GHz (e.g., a 6.5 GHz frequency band, an 8 GHz frequency band, and/or at other suitable frequencies).

As shown in FIG. 2, wireless circuitry 34 may also include non-UWB transceiver circuitry 38. Non-UWB transceiver circuitry 38 may handle communications bands other than UWB communications bands such as 2.4 GHz and 5 GHz bands for Wi-Fi® (IEEE 802.11) communications or communications in other wireless local area network (WLAN) bands, the 2.4 GHz Bluetooth® communications band or other wireless personal area network (WPAN) bands, and/or cellular telephone frequency bands such as a cellular low band (LB) from 600 to 960 MHz, a cellular low-midband (LMB) from 1410 to 1510 MHz, a cellular midband (MB) from 1710 to 2170 MHz, a cellular high band (HB) from 2300 to 2700 MHz, a cellular ultra-high band (UHB) from 3400 to 3600 MHz, or other communications bands between 600 MHz and 4000 MHz or other suitable frequencies (as examples).

Non-UWB transceiver circuitry 38 may handle voice data and non-voice data. Wireless circuitry 34 may include circuitry for other short-range and long-range wireless links if desired. For example, wireless circuitry 34 may include 60 GHz transceiver circuitry (e.g., millimeter wave transceiver circuitry), circuitry for receiving television and radio signals, paging system transceivers, near field communications (NFC) circuitry, etc.

Wireless circuitry 34 may include antennas 40. Antennas 40 may be formed using any suitable types of antenna structures. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of two or more of these designs, etc. If desired, one or more of antennas 40 may be cavity-backed antennas.

Different types of antennas may be used for different bands and combinations of bands. For example, one type of antenna may be used in forming a local wireless link antenna and another type of antenna may be used in forming a remote wireless link antenna. Dedicated antennas may be used for conveying radio-frequency signals in a UWB communications band or, if desired, antennas 40 can be configured to convey both radio-frequency signals in a UWB communications band and radio-frequency signals in a non-UWB communications band (e.g., wireless local area network signals and/or cellular telephone signals). Antennas 40 can include two or more antennas for handling ultra-wideband wireless communication. In one suitable arrangement that is described herein as an example, antennas 40 include one or more sets of three antennas (sometimes referred to herein as triplets of antennas) for handling ultra-wideband wireless communication.

Space is often at a premium in electronic devices such as device 10. In order to minimize space consumption within device 10, the same antenna 40 may be used to cover multiple frequency bands. In one suitable arrangement that is described herein as an example, each antenna 40 that is used to perform ultra-wideband wireless communication may be a multi-band antenna that conveys radio-frequency signals in at least two ultra-wideband communications bands (e.g., the 6.5 GHz band and the 8.0 GHz band). Radio-frequency signals that are conveyed in UWB communications bands (e.g., using a UWB protocol) may sometimes be referred to herein as UWB signals or UWB radio-frequency signals. Radio-frequency signals in frequency bands other than the UWB communications bands (e.g., radio-frequency signals in cellular telephone frequency bands, WPAN frequency bands, WLAN frequency bands, etc.) may sometimes be referred to herein as non-UWB signals or non-UWB radio-frequency signals.

Figure 3:
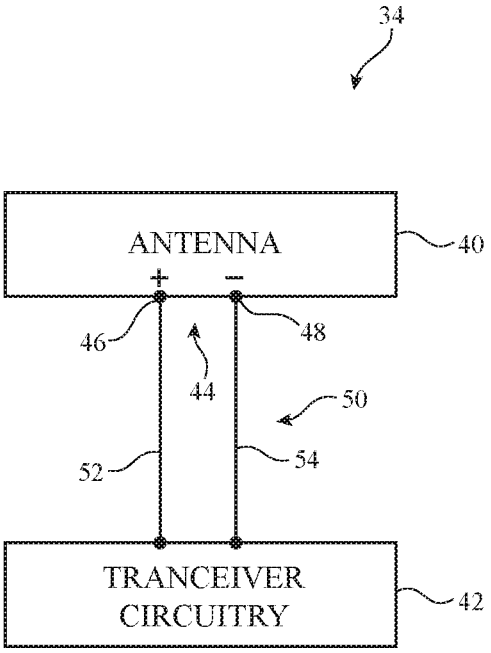
FIG. 3 is a schematic diagram of illustrative wireless circuitry in accordance with some embodiments.

A schematic diagram of wireless circuitry 34 is shown in FIG. 3. As shown in FIG. 3, wireless circuitry 34 may include transceiver circuitry 42 (e.g., UWB transceiver circuitry 36 or non-UWB transceiver circuitry 38 of FIG. 2) that is coupled to a given antenna 40 using a path such as path 50.

To provide antenna structures such as antenna 40 with the ability to cover different frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components that tune the antenna over communications (frequency) bands of interest. The tunable components may be part of a tunable filter or tunable impedance matching network, may be part of an antenna resonating element, may span a gap between an antenna resonating element and antenna ground, etc.

Path 50 may include one or more transmission lines. As an example, path 50 of FIG. 3 may be a transmission line having a positive signal conductor such as line 52 and a ground signal conductor such as line 54. Path 50 may sometimes be referred to herein as transmission line 50 or radio-frequency transmission line 50. Line 52 may sometimes be referred to herein as positive signal conductor 52, signal conductor 52, signal line conductor 52, signal line 52, positive signal line 52, signal path 52, or positive signal path 52 of transmission line 50. Line 54 may sometimes be referred to herein as ground signal conductor 54, ground conductor 54, ground line conductor 54, ground line 54, ground signal line 54, ground path 54, or ground signal path 54 of transmission line 50.

Transmission line 50 may, for example, include a coaxial cable transmission line (e.g., ground conductor 54 may be implemented as a grounded conductive braid surrounding signal conductor 52 along its length), a stripline transmission line, a microstrip transmission line, coaxial probes realized by a metalized via, an edge-coupled microstrip transmission line, an edge-coupled stripline transmission line, a waveguide structure (e.g., a coplanar waveguide or grounded coplanar waveguide), combinations of these types of transmission lines and/or other transmission line structures, etc.

Transmission lines in device 10 such as transmission line 50 may be integrated into rigid and/or flexible printed circuit boards. In one suitable arrangement, transmission lines such as transmission line 50 may also include transmission line conductors (e.g., signal conductors 52 and ground conductors 54) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network may include components such as inductors, resistors, and capacitors used in matching the impedance of antenna 40 to the impedance of transmission line 50. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 50 may be coupled to antenna feed structures associated with antenna 40. As an example, antenna 40 may form an inverted-F antenna, a planar inverted-F antenna, a patch antenna, or other antenna having an antenna feed 44 with a positive antenna feed terminal such as terminal 46 and a ground antenna feed terminal such as ground antenna feed terminal 48. Signal conductor 52 may be coupled to positive antenna feed terminal 46 and ground conductor 54 may be coupled to ground antenna feed terminal 48. Other types of antenna feed arrangements may be used if desired. For example, antenna 40 may be fed using multiple feeds each coupled to a respective port of transceiver circuitry 42 over a corresponding transmission line. If desired, signal conductor 52 may be coupled to multiple locations on antenna 40 (e.g., antenna 40 may include multiple positive antenna feed terminals coupled to signal conductor 52 of the same transmission line 50). Switches may be interposed on the signal conductor between transceiver circuitry 42 and the positive antenna feed terminals if desired (e.g., to selectively activate one or more positive antenna feed terminals at any given time). The illustrative feeding configuration of FIG. 3 is merely illustrative.

During operation, device 10 may communicate with external wireless equipment. If desired, device 10 may use radio-frequency signals conveyed between device 10 and the external wireless equipment to identify a location of the external wireless equipment relative to device 10. Device 10 may identify the relative location of the external wireless equipment by identifying a range to the external wireless equipment (e.g., the distance between the external wireless equipment and device 10) and the angle of arrival (AoA) of radio-frequency signals from the external wireless equipment (e.g., the angle at which radio-frequency signals are received by device 10 from the external wireless equipment).

Figure 4:
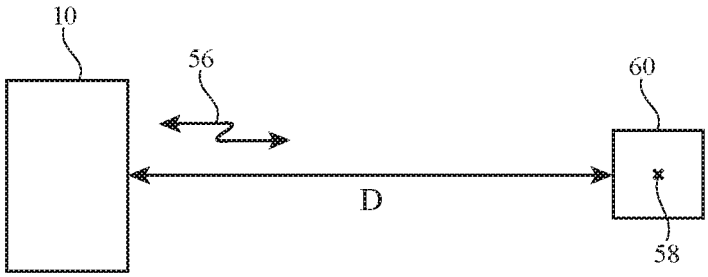
FIG. 4 is a diagram of an illustrative electronic device in wireless communication with an external node in a network in accordance with some embodiments.

FIG. 4 is a diagram showing how device 10 may determine a distance D between device 10 and external wireless equipment such as wireless network node 60 (sometimes referred to herein as wireless equipment 60, wireless device 60, external device 60, or external equipment 60). Node 60 may include devices that are capable of receiving and/or transmitting radio-frequency signals such as radio-frequency signals 56. Node 60 may include tagged devices (e.g., any suitable object that has been provided with a wireless receiver and/or a wireless transmitter), electronic equipment (e.g., an infrastructure-related device), and/or other electronic devices (e.g., devices of the type described in connection with FIG. 1, including some or all of the same wireless communications capabilities as device 10).

For example, node 60 may be a laptop computer, a tablet computer, a somewhat smaller device such as a wrist-watch device, pendant device, headphone device, earpiece device, headset device (e.g., virtual or augmented reality headset devices), or other wearable or miniature device, a handheld device such as a cellular telephone, a media player, or other small portable device. Node 60 may also be a set-top box, a camera device with wireless communications capabilities, a desktop computer, a display into which a computer or other processing circuitry has been integrated, a display without an integrated computer, or other suitable electronic equipment. Node 60 may also be a key fob, a wallet, a book, a pen, or other object that has been provided with a low-power transmitter (e.g., an RFID transmitter or other transmitter). Node 60 may be electronic equipment such as a thermostat, a smoke detector, a Bluetooth® Low Energy (Bluetooth LE) beacon, a Wi-Fi® wireless access point, a wireless base station, a server, a heating, ventilation, and air conditioning (HVAC) system (sometimes referred to as a temperature-control system), a light source such as a light-emitting diode (LED) bulb, a light switch, a power outlet, an occupancy detector (e.g., an active or passive infrared light detector, a microwave detector, etc.), a door sensor, a moisture sensor, an electronic door lock, a security camera, or other device. Device 10 may also be one of these types of devices if desired.

As shown in FIG. 4, device 10 may communicate with node 60 using wireless radio-frequency signals 56. Radio-frequency signals 56 may include Bluetooth® signals, near-field communications signals, wireless local area network signals such as IEEE 802.11 signals, millimeter wave communication signals such as signals at 60 GHz, UWB signals, other radio-frequency wireless signals, infrared signals, etc. In one suitable arrangement that is described herein by example, radio-frequency signals 56 are UWB signals conveyed in multiple UWB communications bands such as the 6.5 GHz and 8 GHz UWB communications bands. Radio-frequency signals 56 may be used to determine and/or convey information such as location and orientation information. For example, control circuitry 28 in device 10 (FIG. 2) may determine the location 58 of node 60 relative to device 10 using radio-frequency signals 56.

In arrangements where node 60 is capable of sending or receiving communications signals, control circuitry 28 (FIG. 2) on device 10 may determine distance D using radio-frequency signals 56 of FIG. 4. The control circuitry may determine distance D using signal strength measurement schemes (e.g., measuring the signal strength of radio-frequency signals 56 from node 60) or using time-based measurement schemes such as time of flight measurement techniques, time difference of arrival measurement techniques, angle of arrival measurement techniques, triangulation methods, time-of-flight methods, using a crowdsourced location database, and other suitable measurement techniques. This is merely illustrative, however. If desired, the control circuitry may use information from Global Positioning System receiver circuitry, proximity sensors (e.g., infrared proximity sensors or other proximity sensors), image data from a camera, motion sensor data from motion sensors, and/or using other circuitry on device 10 to help determine distance D. In addition to determining the distance D between device 10 and node 60, the control circuitry may determine the orientation of device 10 relative to node 60.

Figure 5:
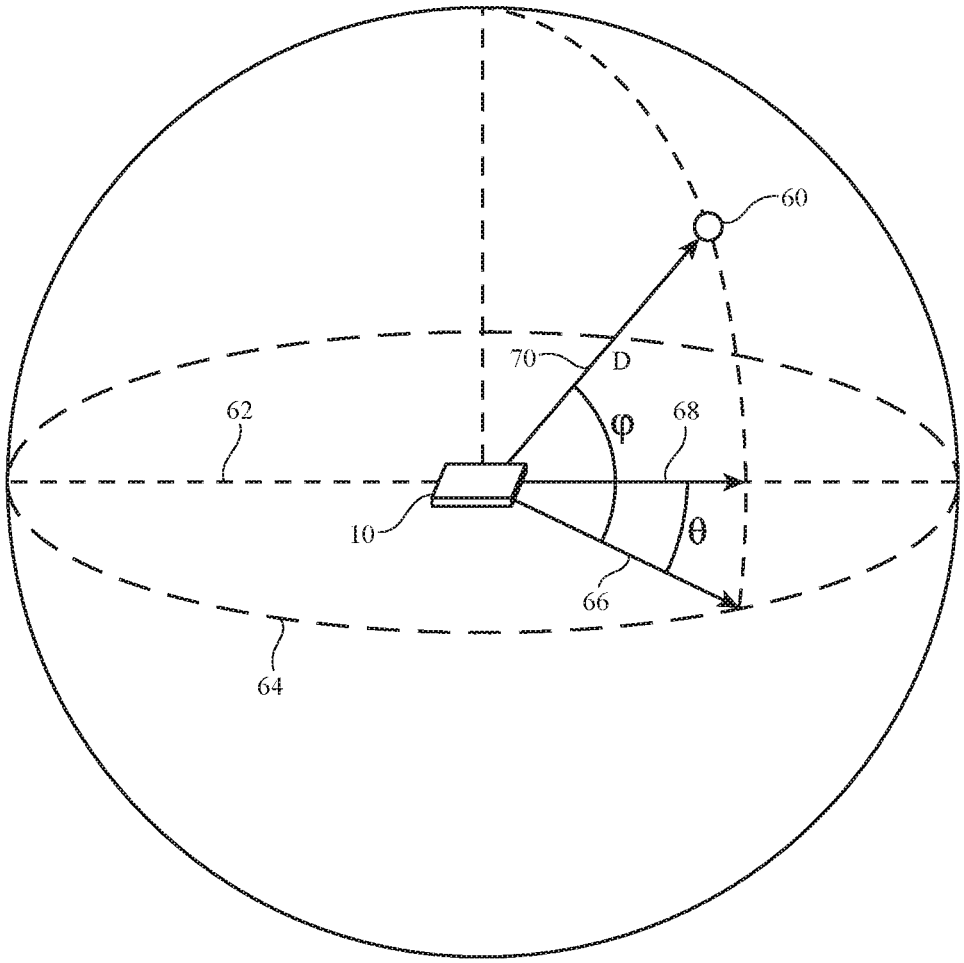
FIG. 5 is a diagram showing how the location (e.g., range and angle of arrival) of an external node in a network may be determined relative to an electronic device in accordance with some embodiments.

FIG. 5 illustrates how the position and orientation of device 10 relative to nearby nodes such as node 60 may be determined. In the example of FIG. 5, the control circuitry on device 10 (e.g., control circuitry 28 of FIG. 2) uses a horizontal polar coordinate system to determine the location and orientation of device 10 relative to node 60. In this type of coordinate system, the control circuitry may determine an azimuth angle θ and/or an elevation angle φ to describe the position of nearby nodes 60 relative to device 10. The control circuitry may define a reference plane such as local horizon 64 and a reference vector such as reference vector 68. Local horizon 64 may be a plane that intersects device 10 and that is defined relative to a surface of device 10 (e.g., the front or rear face of device 10). For example, local horizon 64 may be a plane that is parallel to or coplanar with display 14 of device 10 (FIG. 1). Reference vector 68 (sometimes referred to as the "north" direction) may be a vector in local horizon 64. If desired, reference vector 68 may be aligned with longitudinal axis 62 of device 10 (e.g., an axis running lengthwise down the center of device 10 and parallel to the longest rectangular dimension of device 10, parallel to the Y-axis of FIG. 1). When reference vector 68 is aligned with longitudinal axis 62 of device 10, reference vector 68 may correspond to the direction in which device 10 is being pointed.

Azimuth angle θ and elevation angle φ may be measured relative to local horizon 64 and reference vector 68. As shown in FIG. 5, the elevation angle φ (sometimes referred to as altitude) of node 60 is the angle between node 60 and local horizon 64 of device 10 (e.g., the angle between vector 70 extending between device 10 and node 60 and a coplanar vector 66 extending between device 10 and local horizon 64). The azimuth angle θ of node 60 is the angle of node 60 around local horizon 64 (e.g., the angle between reference vector 68 and vector 66). In the example of FIG. 5, the azimuth angle θ and elevation angle φ of node 60 are greater than 0°.

If desired, other axes besides longitudinal axis 62 may be used to define reference vector 68. For example, the control circuitry may use a horizontal axis that is perpendicular to longitudinal axis 62 as reference vector 68. This may be useful in determining when nodes 60 are located next to a side portion of device 10 (e.g., when device 10 is oriented side-to-side with one of nodes 60).

After determining the orientation of device 10 relative to node 60, the control circuitry on device 10 may take suitable action. For example, the control circuitry may send information to node 60, may request and/or receive information from 60, may use display 14 (FIG. 1) to display a visual indication of wireless pairing with node 60, may use speakers to generate an audio indication of wireless pairing with node 60, may use a vibrator, a haptic actuator, or other mechanical element to generate haptic output indicating wireless pairing with node 60, may use display 14 to display a visual indication of the location of node 60 relative to device 10, may use speakers to generate an audio indication of the location of node 60, may use a vibrator, a haptic actuator, or other mechanical element to generate haptic output indicating the location of node 60, and/or may take other suitable action.

In one suitable arrangement, device 10 may determine the distance between the device 10 and node 60 and the orientation of device 10 relative to node 60 using two or more ultra-wideband antennas. The ultra-wide band antennas may receive radio-frequency signals from node 60 (e.g., radio-frequency signals 56 of FIG. 4). Time stamps in the wireless communication signals may be analyzed to determine the time of flight of the wireless communication signals and thereby determine the distance (range) between device 10 and node 60. Additionally, angle of arrival (AoA) measurement techniques may be used to determine the orientation of electronic device 10 relative to node 60 (e.g., azimuth angle θ and elevation angle φ).

In angle of arrival measurement, node 60 transmits a radio-frequency signal to device 10 (e.g., radio-frequency signals 56 of FIG. 4). Device 10 may measure a delay in arrival time of the radio-frequency signals between the two or more ultra-wideband antennas. The delay in arrival time (e.g., the difference in received phase at each ultra-wideband antenna) can be used to determine the angle of arrival of the radio-frequency signal (and therefore the angle of node 60 relative to device 10). Once distance D and the angle of arrival have been determined, device 10 may have knowledge of the precise location of node 60 relative to device 10.

Figure 6:
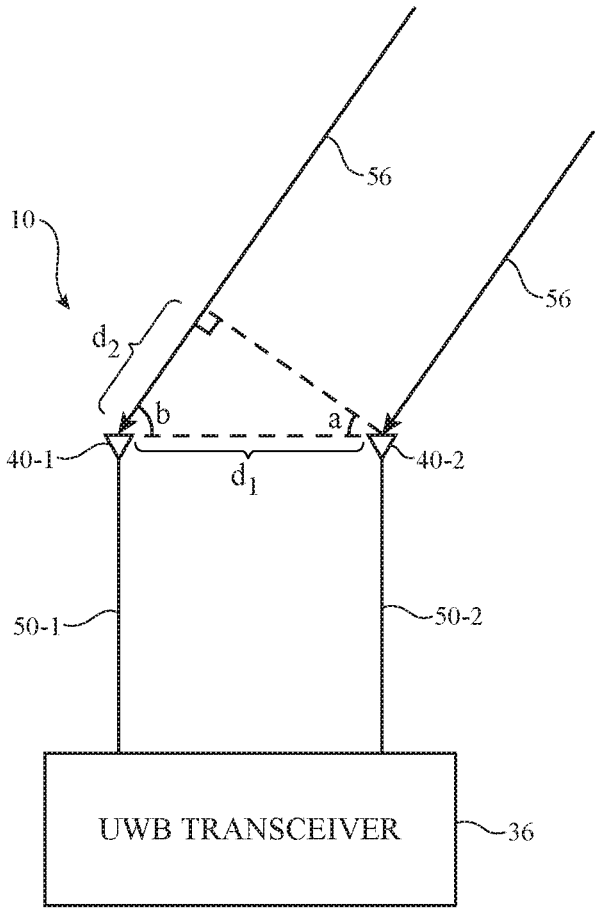
FIG. 6 is a diagram showing how illustrative antennas in an electronic device may be used for detecting angle of arrival in accordance with some embodiments.

FIG. 6 is a schematic diagram showing how angle of arrival measurement techniques may be used to determine the orientation of device 10 relative to node 60. As shown in FIG. 6, device 10 may include multiple antennas (e.g., a first antenna 40-1 and a second antenna 40-2) coupled to UWB transceiver circuitry 36 over respective transmission lines (e.g., a first transmission line 50-1 and a second transmission line 50-2).

Antennas 40-1 and 40-2 may each receive radio-frequency signals 56 from node 60 (FIG. 5). Antennas 40-1 and 40-2 may be laterally separated by a distance $d_1$, where antenna 40-1 is farther away from node 60 than antenna 40-2 (in the example of FIG. 6). Therefore, radio-frequency signals 56 travel a greater distance to reach antenna 40-1 than antenna 40-2. The additional distance between node 60 and antenna 40-1 is shown in FIG. 6 as distance $d_2$. FIG. 6 also shows angles a and b (where a+b=90°).

Distance $d_2$ may be determined as a function of angle a or angle b (e.g., $d_2=d_1*\sin(a)$ or $d_2=d_1*\cos(b)$). Distance $d_2$ may also be determined as a function of the phase difference between the signal received by antenna 40-1 and the signal received by antenna 40-2 (e.g., $d_2=(PD)*\lambda/(2*\pi)$, where PD is the phase difference (sometimes written "$\Delta\phi$") between the signal received by antenna 40-1 and the signal received by antenna 40-2, and $\lambda$ is the wavelength of radio-frequency signals 56. Device 10 may include phase measurement circuitry coupled to each antenna to measure the phase of the received signals and to identify phase difference PD (e.g., by subtracting the phase measured for one antenna from the phase measured for the other antenna). The two equations for $d_2$ may be set equal to each other (e.g., $d_1*\sin(a)=(PD)*\lambda/(2*\pi)$) and rearranged to solve for the angle a (e.g., $a=\sin^{-1}((PD)*\lambda/(2*\pi*d_1))$ or the angle b. Therefore, the angle of arrival may be determined (e.g., by control circuitry 28 of FIG. 2) based on the known (predetermined) distance $d_1$ between antennas 40-1 and 40-2, the detected (measured) phase difference PD between the signal received by antenna 40-1 and the signal received by antenna 40-2, and the known wavelength (frequency) of the received radio-frequency signals 56. Angles a and/or b of FIG. 6 may be converted to spherical coordinates to obtain azimuth angle $\theta$ and elevation angle $\varphi$ of FIG. 5, for example. Control circuitry 28 (FIG. 2) may determine the angle of arrival of radio-frequency signals 56 by calculating one or both of azimuth angle $\theta$ and elevation angle $\varphi$.

Distance $d_1$ may be selected to ease the calculation for phase difference PD between the signal received by antenna 40-1 and the signal received by antenna 40-2. For example, $d_1$ may be less than or equal to one half of the wavelength (e.g., effective wavelength) of the received radio-frequency signals 56 (e.g., to avoid multiple phase difference solutions).

With two antennas for determining angle of arrival (as in FIG. 6), the angle of arrival within a single plane may be determined. For example, antennas 40-1 and 40-2 in FIG. 6 may be used to determine azimuth angle $\theta$ of FIG. 5. A third antenna may be included to enable angle of arrival determination in multiple planes (e.g., azimuth angle $\theta$ and elevation angle $\varphi$ of FIG. 5 may both be determined). The three antennas in this scenario may form a so-called triplet of antennas, where each antenna in the triplet is arranged to lie on a respective corner of a right triangle (e.g., the triplet may include antennas 40-1 and 40-2 of FIG. 6 and a third antenna located at distance $d_1$ from antenna 40-1 in a direction perpendicular to the vector between antennas 40-1 and 40-2). Triplets of antennas 40 may be used to determine angle of arrival in two planes (e.g., to determine both azimuth angle $\theta$ and elevation angle $\varphi$ of FIG. 5). Triplets of antennas 40 and/or doublets of antennas (e.g., a pair of antennas such as antennas 40-1 and 40-2 of FIG. 6) may be used in device 10 to determine angle of arrival. If desired, different doublets of antennas may be oriented orthogonally with respect to each other in device 10 to recover angle of arrival in two dimensions (e.g., using two or more orthogonal doublets of antennas 40 that each measure angle of arrival in a single respective plane).

Figure 7:
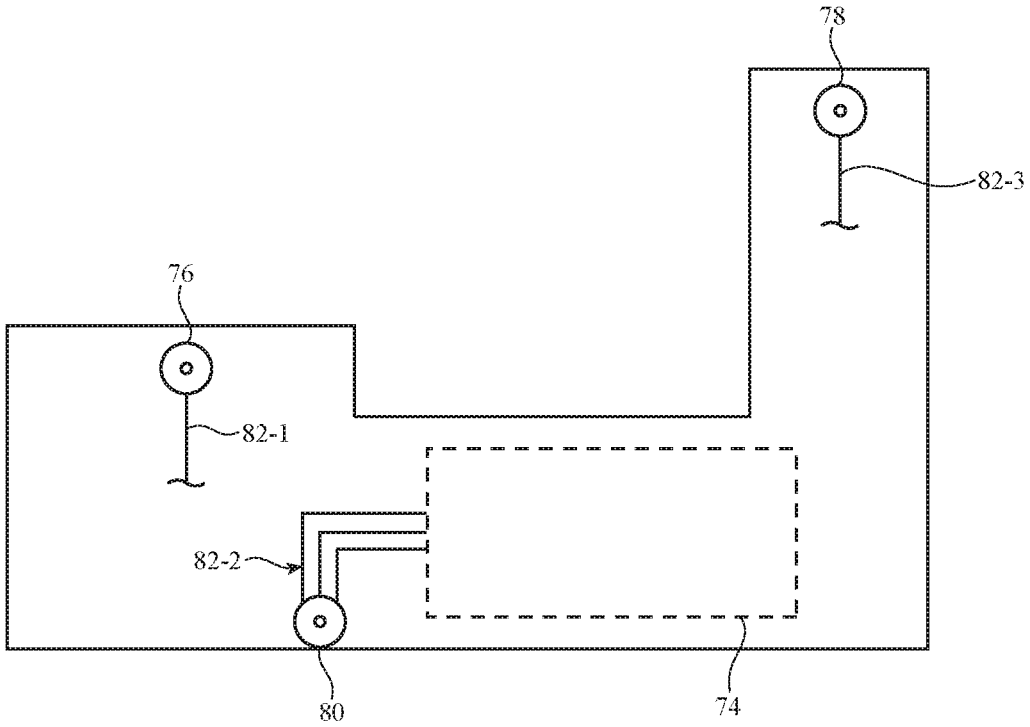
FIG. 7 is a top down view of an illustrative flexible printed circuit having antennas for detecting range and angle of arrival in accordance with some embodiments.

If desired, each antenna in a triplet or doublet of antennas used by device 10 for performing ultra-wideband communications may be mounted to a common substrate. FIG. 7 is a top-down view showing how antennas 40 may be mounted to a common substrate such as a flexible printed circuit. As shown in FIG. 7, two or more antennas for performing ultra-wideband communications (e.g., a triplet of antennas) may be mounted to flexible printed circuit 72 within region 74. The antennas in region 74 may be fed using transmission lines 82-2 (e.g., a set of three transmission lines such as transmission line 50 of FIG. 3). Transmission lines 82-2 may be coupled to UWB transceiver circuitry 36 of FIG. 2 over radio-frequency connector 80. Radio-frequency connector 80 may be a coaxial cable connector or any other desired radio-frequency connector. The UWB transceiver circuitry may be formed on a separate substrate such as a main logic board for device 10.

If desired, other components may be mounted to flexible printed circuit 72 (e.g., input-output devices 26 or portions of control circuitry 28 of FIG. 2, additional antennas, etc.). Flexible printed circuit 72 may include additional radio-frequency transmission lines for routing radio-frequency signals for other antennas in device 10. For example, flexible printed circuit 72 may include transmission lines 82-1 and 82-3. Transmission line 82-1 may be coupled to an antenna that covers non-UWB frequency bands such as a WLAN frequency band via radio-frequency connector 76. Similarly, transmission line 82-2 may be coupled to an antenna that covers non-UWB frequency bands such as cellular telephone frequency bands via radio-frequency connector 78. Integrating different radio-frequency transmission lines for covering different frequency bands into the same flexible printed circuit 72 may serve to minimize space consumption and optimize transmission line routing within device 10, for example.

The example of FIG. 7 is merely illustrative. In general, flexible printed circuit 72 may have any desired shape and may include any desired number of radio-frequency connectors. If desired, some but not all of the antennas in a given triplet of antennas for conveying UWB signals may be formed in region 74. One or more of the antennas in the triplet may be located on another substrate if desired. Flexible printed circuit 72 may be replaced with any other desired substrate such as a rigid printed circuit board, plastic substrate, etc.

Any desired antenna structures may be used for implementing the antennas in region 74 of FIG. 7 (e.g., for implementing antennas 40-1 and 40-2 of FIG. 6 for conveying UWB signals). In one suitable arrangement that is sometimes described herein as an example, planar inverted-F antenna structures may be used for implementing antennas 40-1 and 40-2. Antennas that are implemented using planar inverted-F antenna structures may sometimes be referred to herein as planar inverted-F antennas.

Figure 8:
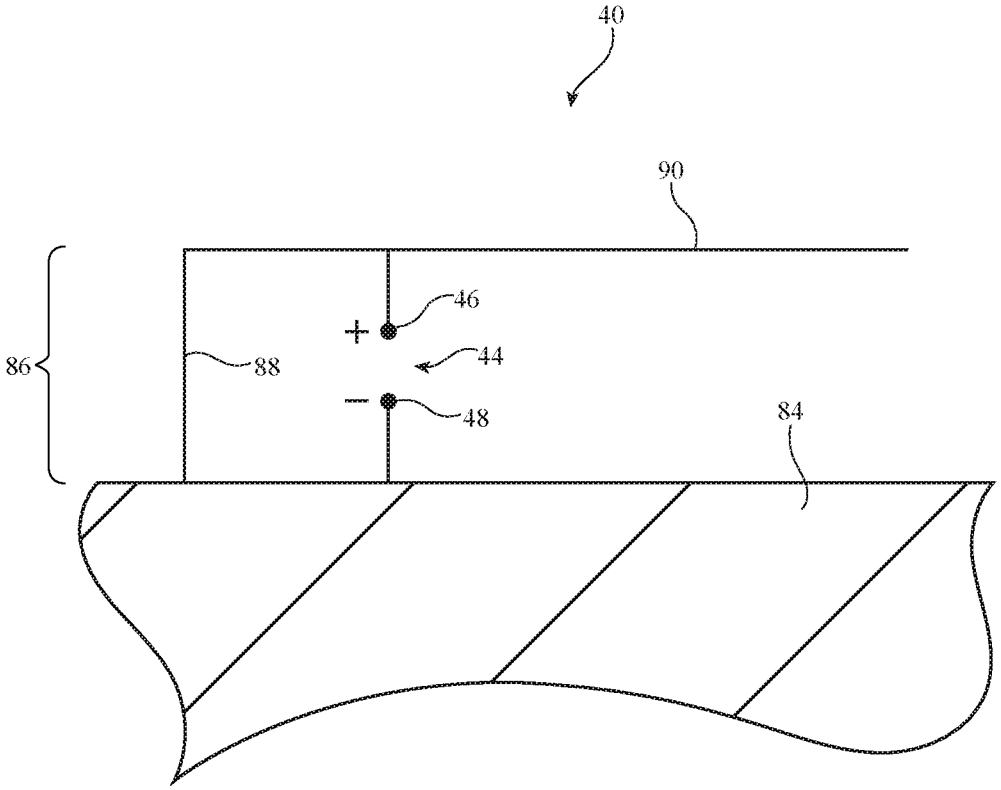
FIG. 8 is a schematic diagram of illustrative inverted-F antenna structures in accordance with some embodiments.

FIG. 8 is a schematic diagram of inverted-F antenna structures that may be used to form antenna 40 (e.g., a given one of antennas 40-1 and 40-2 of FIG. 6). As shown in FIG. 8, antenna 40 may include an antenna resonating element such as antenna resonating element 86 and an antenna ground such as antenna ground 84. Antenna resonating element 86 may include a resonating element arm 90 (sometimes referred to herein as an antenna resonating element arm) that is shorted to antenna ground 84 by return path 88. Antenna 40 may be fed by coupling a radio-frequency transmission line (e.g., transmission line 50 of FIG. 3) to positive antenna feed terminal 46 and ground antenna feed terminal 48 of antenna feed 44. Positive antenna feed terminal 46 may be coupled to resonating element arm 90 and ground antenna feed terminal 48 may be coupled to antenna ground 84. Return path 88 may be coupled between resonating element arm 90 and antenna ground 84 in parallel with antenna feed 44. The length of resonating element arm 90 may determine the resonant frequency of the antenna.

Figure 9:
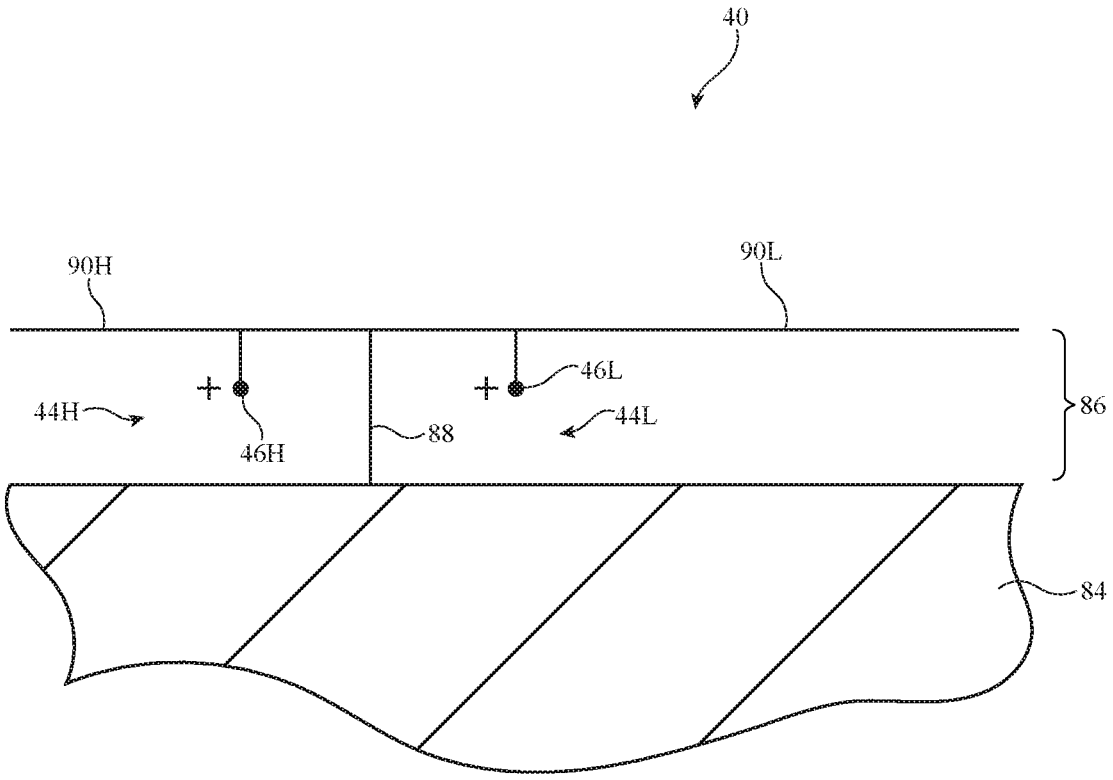
FIG. 9 is a schematic diagram of illustrative dual-band inverted-F antenna structures in accordance with some embodiments.

In the example of FIG. 8, antenna 40 is configured to cover only a single frequency band. If desired, antenna resonating element 86 may include multiple resonating element arms 90 that configure antenna 40 to cover multiple frequency bands. FIG. 9 is a schematic diagram of dual-band inverted-F antenna structures that may be used to form antenna 40 (e.g., a given one of antennas 40-1 and 40-2 of FIG. 6). As shown in FIG. 9, antenna resonating element 86 includes a first resonating element arm 90L and a second resonating element arm 90H extending from opposing sides of return path 88.

The length of first resonating element arm 90L (sometimes referred to herein as low band arm 90L) may be selected to radiate in a first frequency band and the length of second resonating element arm 90H (sometimes referred to herein as high band arm 90H) may be selected to radiate in a second frequency band at higher frequencies than the first frequency band. As an example, low band arm 90L may have a length that configures low band arm 90L to radiate in the 6.5 GHz UWB band whereas high band arm 90H has a length that configures high band arm 90H to radiate in the 8.0 GHz UWB band.

Antenna 40 of FIG. 9 may be fed using two antenna feeds such as antenna feed 44H and antenna feed 44L. Antenna feed 44H may include a positive antenna feed terminal 46H coupled to high band arm 90H. Antenna feed 44L may include a positive antenna feed terminal 46L coupled to low band arm 90L. The ground antenna feed terminals of antenna feeds 44L and 44H are not shown in the example of FIG. 9 for the sake of clarity. If desired, antenna feeds 44L and 44H may share the same ground antenna feed terminal. Positive antenna feed terminals 46H and 46L may both be coupled to the same radio-frequency transmission line (e.g., to the same signal conductor 52 as shown in FIG. 3). This may, for example, optimize antenna efficiency of antenna 40 in both the frequency band covered by low band arm 90L and the frequency band covered by high band arm 90H (e.g., because antenna current may be conveyed to each resonating element arm over the corresponding positive antenna feed terminal without first shorting to ground over return path 88).

In one suitable arrangement that is sometimes described herein as an example, antenna 40 may be a dual-band planar inverted-F antenna. When configured as a dual-band planar inverted-F antenna, resonating element arms 90H and 90L may be formed using a conductive structure (e.g., a conductive trace, sheet metal, conductive foil, etc.) that extends across a planar lateral area above antenna ground 84.

Figure 10:
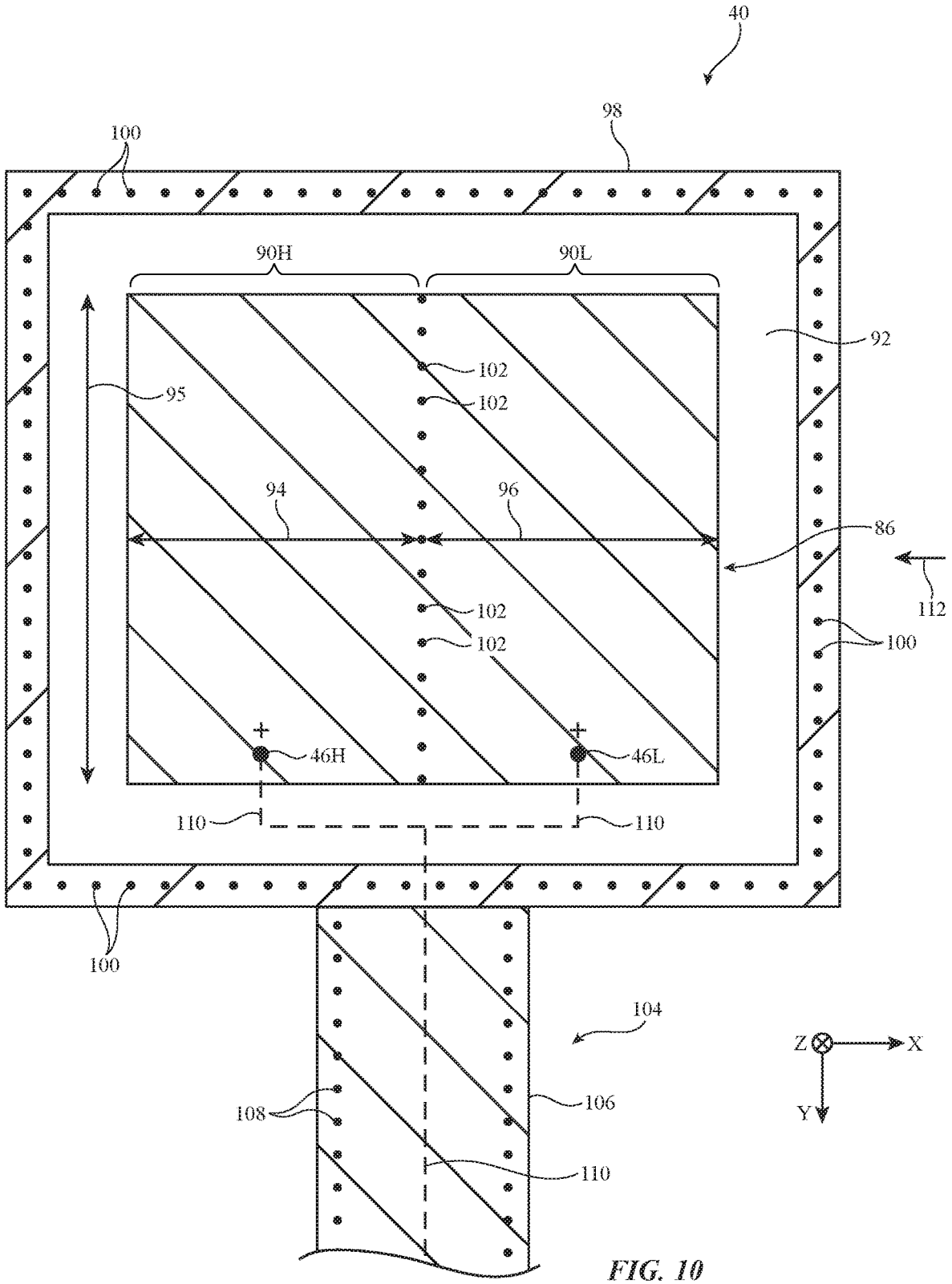
FIG. 10 is a top view of an illustrative dual-band planar inverted-F antenna that conveys radio-frequency signals in multiple ultra-wideband communications bands in accordance with some embodiments.

FIG. 10 is a top-down view of dual-band planar inverted-F antenna structures that may be used to form antenna 40 (e.g., a given one of antennas 40-1 and 40-2 of FIG. 6). As shown in FIG. 10, antenna resonating element 86 of antenna 40 (e.g., a dual-band planar inverted-F antenna) may be formed from conductive structures such as conductive traces on the surface of an underlying dielectric substrate 92. Dielectric substrate 92 may be formed from any desired dielectric materials such as epoxy, plastic, ceramic, glass, foam, polyimide, liquid crystal polymer, or other materials. In one suitable arrangement that is described herein as an example, dielectric substrate 92 is a flexible printed circuit substrate having stacked layers of flexible printed circuit material (e.g., polyimide, liquid crystal polymer, etc.). Dielectric substrate 92 may therefore sometimes be referred to herein as flexible printed circuit substrate 92.

As shown in FIG. 10, antenna resonating element 86 may have a planar shape with a length equal to the sum of the length 94 of high band arm 90H and the length 96 of low band arm 90L. Antenna resonating element 86 (e.g., each of resonating element arms 90H and 90L) may have a perpendicular width 95 such that antenna resonating element 86 has a planar shape that laterally extends in a given plane (e.g., the X-Y plane of FIG. 10) parallel to the antenna ground (e.g., antenna ground 84 of FIG. 9). In other words, low band arm 90L has length 96 and width 95 whereas high band arm 90H has length 94 and width 95.

Length 94 may be selected to configure high band arm 90H to radiate in a relatively high frequency band such as the 8.0 GHz UWB band. Length 96 may be selected to configure low band arm 90L to radiate in a relatively low frequency band such as the 6.5 GHz UWB band. For example, length 94 may be approximately equal to (e.g., within 15% of) one-quarter of the effective wavelength corresponding to a frequency in the 8.0 GHz UWB band. Similarly, length 96 may be approximately equal to one-quarter of the effective wavelength corresponding to a frequency in the 6.5 GHz UWB band. These effective wavelengths are modified from free-space wavelengths by a constant value associated with the dielectric material used to form flexible printed circuit substrate 92 (e.g., the effective wavelengths are found by multiplying the freespace wavelengths by a constant value that is based on the dielectric constant $d_k$ of flexible printed circuit substrate 92). This example is merely illustrative and, in general, any desired frequency bands (e.g., UWB communications bands) may be covered by resonating element arms 90L and 90H.

Low band arm 90L may be separated from high band arm 90H in antenna resonating element 86 by a fence of conductive vias 102. Conductive vias 102 extend from the surface of flexible printed circuit substrate 92, through flexible printed circuit substrate 92, and to an underlying ground plane (e.g., in the direction of the Z-axis of FIG. 10). The fence of conductive vias 102 may form the return path for antenna 40 (e.g., return path 88 of FIG. 9).

Each conductive via 102 may be separated from one or more adjacent conductive vias 102 by a sufficiently narrow distance such that the portion of antenna resonating element 86 to the left of the fence of conductive vias 102 appears as an open circuit (infinite impedance) to antenna currents in the 6.5 GHz frequency band and such that the portion of antenna resonating element 86 to the right of the fence of conductive vias 102 appears as an open circuit (infinite impedance) to antenna currents in the 8.0 GHz frequency band. As an example, each conductive via 102 in the fence may be separated from one or more adjacent conductive vias 102 by one-sixth of the wavelength covered by high band arm 90H, one-eighth of the wavelength covered by high band arm 90H, one-tenth of the wavelength covered by high band arm 90H, one-fifteenth of the wavelength covered by high band arm 90H, less than one-fifteenth of the wavelength covered by high band arm 90H, less than one-sixth of the wavelength covered by high band arm 90H, etc.

If desired, a grounded shielding ring 98 may laterally surround antenna resonating element 86 at the surface of flexible printed circuit substrate 92. Grounded shielding ring 98 may be formed from conductive traces on the surface of flexible printed circuit substrate 92. The conductive traces of grounded shielding ring 98 are shorted to the antenna ground (e.g., an underlying ground plane) by fences of conductive vias 100 extending through flexible printed circuit substrate 92 (e.g., in the direction of the Z-axis of FIG. 10). Grounded shielding ring 98 and conducive vias 100 may serve to isolate and shield antenna 40 from electromagnetic interference. Grounded shielding ring 98, conductive vias 100, and the underlying ground plane may collectively form antenna ground 84 of FIG. 9 and may form (define) a conductive antenna cavity for antenna 40 that serves to optimize radio-frequency performance (e.g., antenna efficiency and bandwidth) for antenna 40.

Antenna 40 of FIG. 10 may be fed using a radio-frequency transmission line such as stripline 104 (e.g., a stripline used to form transmission line 50 of FIG. 3 or one of transmission lines 82-2 of FIG. 7). Stripline 104 may be formed on a flexible printed circuit underlying flexible printed circuit substrate 92 (e.g., flexible printed circuit substrate 92 may be mounted to the underlying flexible printed circuit used to form stripline 104). Stripline 104 may include grounded conductive traces 106 and fences of conductive vias 108 extending from grounded conductive traces 106 to an underlying ground plane (e.g., in the direction of the Z-axis of FIG. 10). Each conductive via 108 may be separated from one or more adjacent conductive vias 108 and each conductive via 100 may be separated from one or more adjacent conductive vias 100 by one-eighth of the wavelength covered by high band arm 90H, one-tenth of the wavelength covered by high band arm 90H, one-fifteenth of the wavelength covered by high band arm 90H, less than one-fifteenth of the wavelength covered by high band arm 90H, less than one-sixth of the wavelength covered by high band arm 90H, etc.

Stripline 104 may include signal conductor traces 110 (e.g., signal conductor traces that collectively form signal conductor 52 of FIG. 3). Signal conductor traces 110 may be embedded within the flexible printed circuit underlying flexible printed circuit substrate 92. Signal conductor traces 110 may include a first branch coupled to positive antenna feed terminal 46H on high band arm 90H and a second branch coupled to positive antenna feed terminal 46L on low band arm 90L. Conductive vias (not shown) may be used to couple signal conductor traces 110 in the underlying flexible printed circuit to positive antenna feed terminals 46H and 46L (e.g., through flexible printed circuit substrate 92). In this way, the same radio-frequency transmission line (stripline 104) may be used to feed both high band arm 90H and low band arm 90L of antenna 40.

In the example of FIG. 10, antenna 40 is only capable of conveying radio-frequency signals with a single linear polarization. In other words, high band arm 90H conveys radio-frequency signals in the 8.0 GHz UWB band with a given linear polarization and low band arm 90L conveys radio-frequency signals in the 6.5 UWB band with the same linear polarization. Additional polarizations may be covered in device 10 by providing additional antennas oriented perpendicular to each other if desired. The example of FIG. 10 is merely illustrative. If desired, antenna resonating antenna 40 and/or grounded shielding ring 98 may have other shapes (e.g., shapes having any desired number of straight and/or curved edges).

Figure 11:
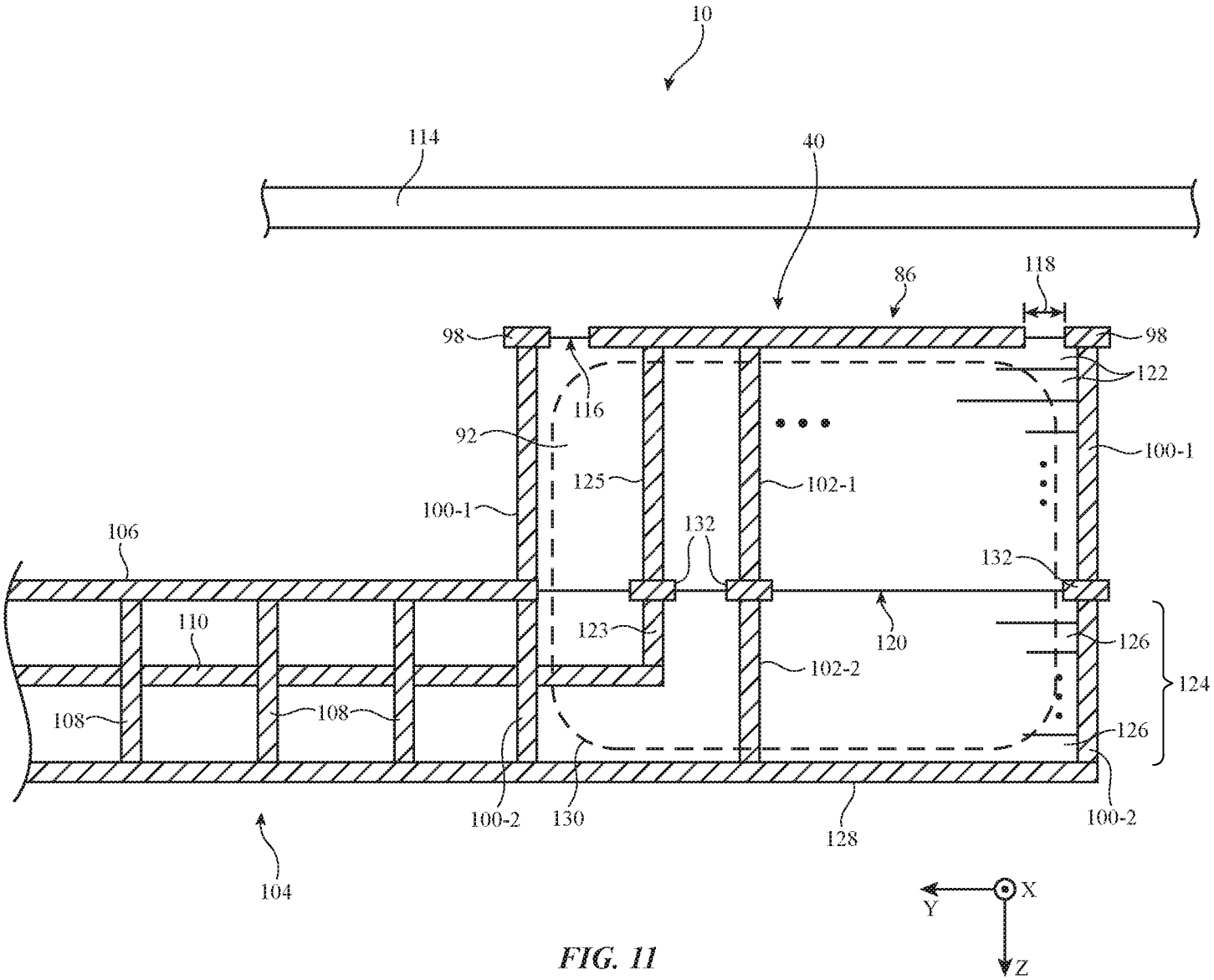
FIG. 11 is a cross-sectional side view of an illustrative dual-band planar inverted-F antenna formed on a dielectric substrate mounted to a flexible printed circuit in accordance with some embodiments.

FIG. 11 is a cross-sectional side view of the dual-band planar inverted-F antenna of FIG. 10 (e.g., as taken in the direction of arrow 112 of FIG. 10). As shown in FIG. 11, antenna resonating element 86 may be formed from conductive traces on surface 116 of flexible printed circuit substrate 92. Flexible printed circuit substrate 92 may include one or more stacked layers 122 of flexible printed circuit material (e.g., polyimide, liquid crystal polymer, etc.). This example is merely illustrative and, if desired, one or more additional layers 122 of flexible printed circuit substrate 92 may be formed over surface 116 and antenna resonating element 86.

Flexible printed circuit substrate 92 may be mounted to the surface of an underlying flexible printed circuit. In the example of FIG. 11, flexible printed circuit substrate 92 is mounted to surface 120 of an underlying flexible printed circuit 124. Flexible printed circuit 124 may include one or more stacked layers 126 of flexible printed circuit material (e.g., polyimide, liquid crystal polymer, etc.). While flexible printed circuit substrate 92 is shown with a greater thickness (in the direction of the Z-axis) than flexible printed circuit 124 for the sake of clarity, flexible printed circuit 124 may be thicker than flexible printed circuit substrate 92. In one suitable arrangement, there may be a greater number of layers 126 than layers 122 in device 10.

Flexible printed circuit substrate 92 may be mounted to surface 120 using surface-mount technology, solder, adhesive, screws, pins, clips, springs, and/or any other desired interconnect structures. In the example of FIG. 11, conductive interconnect structures 132 are used to couple conductive structures in flexible printed circuit substrate 92 to conductive structures in flexible printed circuit 124. Conductive interconnect structures 132 may include solder and conductive contact pads in one suitable arrangement. If desired, conductive interconnect structures 132 may include other conductive interconnect structures such as conductive adhesive, screws, pins, clips, springs, etc.

Flexible printed circuit 124 may include conductive traces that form a ground plane (layer) such as ground plane 128. Ground plane 128 may be formed on a surface of flexible printed circuit 124 (as shown in the example of FIG. 11) or may be embedded within layers 126 of flexible printed circuit 124. Ground plane 128 may form a part of stripline 104 for antenna 40 and may extend under antenna resonating element 86 (e.g., antenna resonating element 86 may overlap ground plane 128). Conductive vias 108 may extend through flexible printed circuit 124 to short the grounded traces 106 in stripline 104 to ground plane 128.

Signal conductor traces 110 are interposed between ground plane 128 and grounded traces 106 in stripline 104. Conductive via 123 may extend from signal conductor traces 110 through flexible printed circuit 124 to conductive interconnect structures 132. Conductive via 125 may extend from conductive interconnect structures 132 through flexible printed circuit substrate 92 to antenna resonating element 86 (e.g., at a given one of positive antenna feed terminals 46H and 46L of FIG. 10). While FIG. 11 only shows a single conductive via 123 and a single conductive via 125, antenna 40 may include two conductive vias 123 and two conductive vias 125 for coupling signal conductor traces 110 to both positive antenna feed terminals 46H and 46L of FIG. 10.

Grounded shielding ring 98 may be formed on surface 116 of flexible printed circuit substrate 92. Grounded shielding ring 98 may surround the periphery of antenna resonating element 86 at surface 116. Grounded shielding ring 98 may be separated from antenna resonating element 86 by gap 118. Gap 118 may be large enough to allow for some tolerance in manufacturing antenna 40 while also being small enough to minimize the footprint of antenna 40 within device 10. As an example, gap 118 may be between 0.4 mm and 0.6 mm (e.g., 0.5 mm) in length. Grounded shielding ring 98 may be shorted to ground plane 128 by conductive vias 100-1 and 100-2. Conductive vias 100-1 may extend from grounded shielding ring 98 through flexible printed circuit substrate 92 to conductive interconnect structures 132 and/or grounded traces 106 on flexible printed circuit 124. Conductive vias 100-2 may extend from conductive vias 100-1 (e.g., at conductive interconnect structures 132 and/or grounded traces 106) through flexible printed circuit 124 to ground plane 128. Conductive vias 100-1 and 100-2 of FIG. 11 may collectively form conductive vias 100 of FIG. 10.

Similarly, conductive vias 102-1 may extend from antenna resonating element 86 through flexible printed circuit substrate 92 to conductive interconnect structures 132 on flexible printed circuit 124. Conductive vias 102-2 may extend from conductive vias 102-1 (e.g., at conductive interconnect structures 132) through flexible printed circuit 124 to ground plane 128. Conductive vias 102-1 and 102-2 of FIG. 11 may collectively form conductive vias 102 of FIG. 10. Antenna 40 may include multiple conductive vias 102-1 and multiple conductive vias 102-2 (e.g., a fence of conductive vias 102 as shown in FIG. 10) to form the return path for antenna 40 (e.g., return path 88 of FIG. 9).

Conductive vias 100-1 and 100-2, antenna resonating element 86, and ground plane 128 may define a continuous antenna cavity (volume) 130 for antenna 40. In general, the bandwidth of antenna 40 is proportional to the size of antenna cavity 130. The portion of surface 120 underlying antenna resonating element 86 may be free from grounded traces 106 to maximize the size of antenna cavity 130 (e.g., allowing antenna cavity 130 to extend downward to ground plane 128). This may serve to maximize bandwidth and efficiency for antenna 40. Grounded shielding ring 98 and conductive vias 100-1 and 100-2 may also serve to shield antenna 40 from external electromagnetic interference.

If desired, flexible printed circuit 124 may be mounted to another substrate such as flexible printed circuit 72 of FIG. 7 or may be formed from a part of flexible printed circuit 72. As shown in FIG. 11, flexible printed circuit 124 and antenna 40 may be mounted within device 10 adjacent to a dielectric cover layer such as dielectric cover layer 114. Dielectric cover layer 114 may form a dielectric rear wall for device 10 (e.g., dielectric cover layer 114 of FIG. 11 may form part of rear housing wall 12R of FIG. 1) or may form a display cover layer for device 10 (e.g., dielectric cover layer 114 of FIG. 11 may be a display cover layer for display 14 of FIG. 1), as examples. Dielectric cover layer 114 may be formed from a visually opaque material, may be provided with pigment so that dielectric cover layer 114 is visually opaque, or may be provided with an ink layer that hides antenna 40 from view, if desired. Antenna resonating element 86 may be separated from dielectric cover layer 114 by an air gap, may be adhered to dielectric cover layer 114 using adhesive, or may be pressed against dielectric cover layer 114 if desired. Antenna 40 may convey radio-frequency signals through dielectric cover layer 114.

Figure 12:
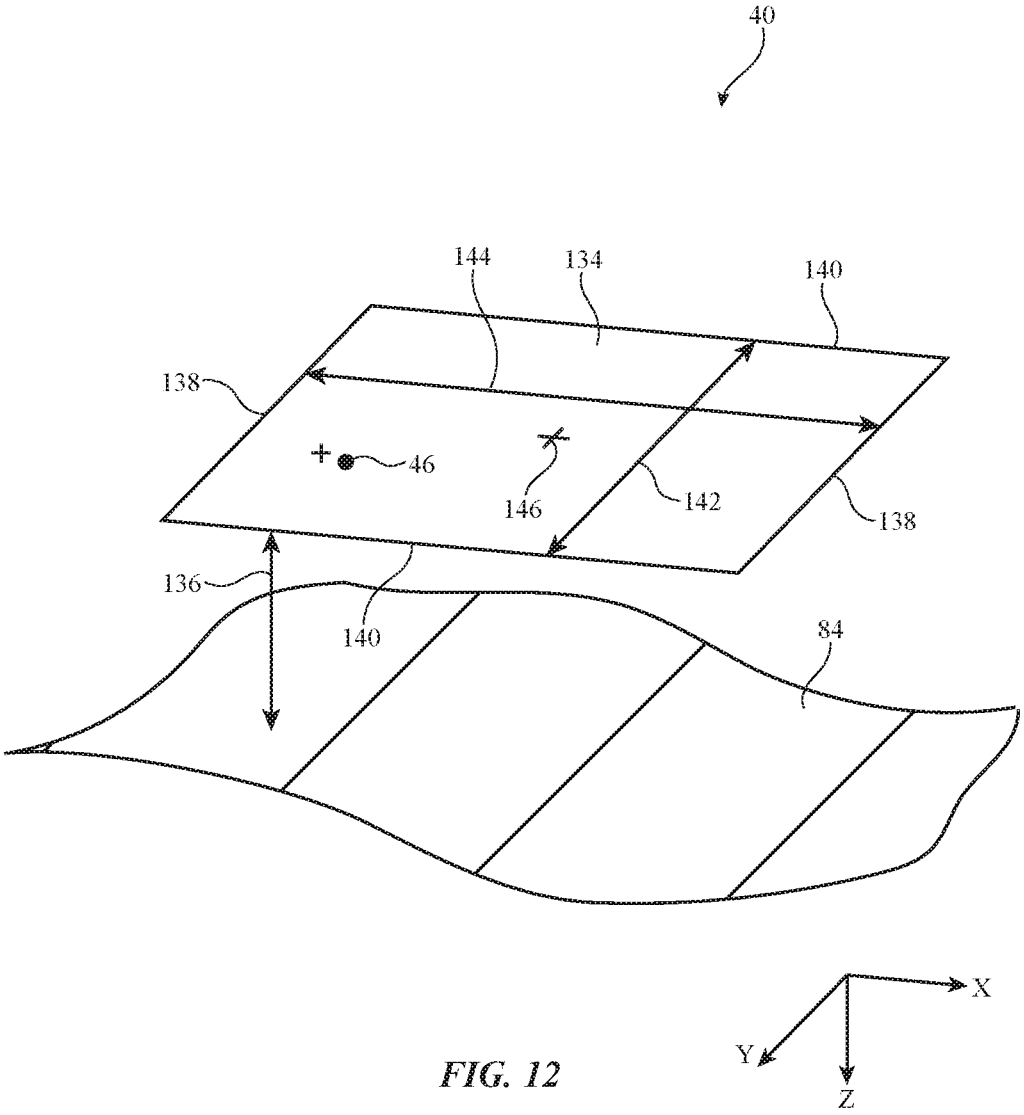
FIG. 12 is a perspective view of an illustrative dual-band patch antenna that conveys radio-frequency signals in multiple ultra-wideband communications bands in accordance with some embodiments.

The example of FIGS. 10 and 11 in which antenna 40 is implemented as a dual-band planar inverted-F antenna is merely illustrative. In another suitable arrangement, antenna 40 may be implemented as a dual-band patch antenna. FIG. 12 is a perspective view of dual-band patch antenna structures that may be used to form antenna 40 (e.g., a given one of antennas 40-1 and 40-2 of FIG. 6). As shown in FIG. 12, antenna 40 (e.g., a dual-band patch antenna) may have an antenna resonating element 134 that is separated from antenna ground 84. Antenna resonating element 134 may sometimes be referred to herein as patch element 134, patch antenna resonating element 134, patch radiating element 134, or patch 134.

Patch element 134 may lie within a plane such as the X-Y plane of FIG. 12. Antenna ground 84 may lie within a plane that is parallel to the plane of patch element 134. Patch element 134 and antenna ground 84 may therefore lie in separate parallel planes that are separated by a distance 136. In general, greater distances (heights) 136 may allow antenna 40 to exhibit a greater bandwidth than shorter distances 136. However, greater distances 136 may consume more volume within device 10 than shorter distances 136.

The perimeter of patch element 134 may be selected so that antenna 40 radiates in first and second frequency bands (e.g., the 6.5 GHz and 8.0 GHz UWB bands). Opposing edges 138 of patch element 134 may have a length 142 that is selected to radiate in the 8.0 GHz UWB band whereas opposing edges 140 of patch element 134 may have a length 144 that is selected to radiate in the 6.5 GHz UWB band. Length 142 may be, for example, one-half of the effective wavelength corresponding to a frequency in the 8.0 GHz UWB band. Similarly, length 144 may be one-half of the effective wavelength corresponding to a frequency in the 6.5 GHz UWB band. This example is merely illustrative and, in general, antenna 40 may be configured to cover any desired UWB communications bands and patch element 134 may have any desired number of curved and/or straight edges.

Patch element 134 may be fed using a single positive antenna feed terminal 46. Radio-frequency signals conveyed over positive antenna feed terminal 46 may excite a first radiating mode of patch element 134 associated with edges 138 and length 142 and may excite a second radiating mode of patch element 134 associated with edges 140 and length 144. The radiating mode associated with edges 138 and length 142 may be used to convey the radio-frequency signals with a first linear polarization. The radiating mode associated with edges 140 and length 144 may be used to convey the radio-frequency signals with a second linear polarization. Because edges 140 are perpendicular to edges 138 (in the example of FIG. 12), the first linear polarization is orthogonal to the second linear polarization. In this way, antenna 40 may convey radio-frequency signals with multiple polarizations, whereas the dual-band planar inverted-F antenna of FIGS. 10 and 11 conveys radio-frequency signals with only a single linear polarization. As shown in FIG. 12, positive antenna feed terminal 46 may be offset from the center 146 of patch element 134 by a distance that is selected to match the impedance of antenna 40 for both polarizations to the impedance of the transmission line coupled to positive antenna feed terminal 46.

Figure 13:
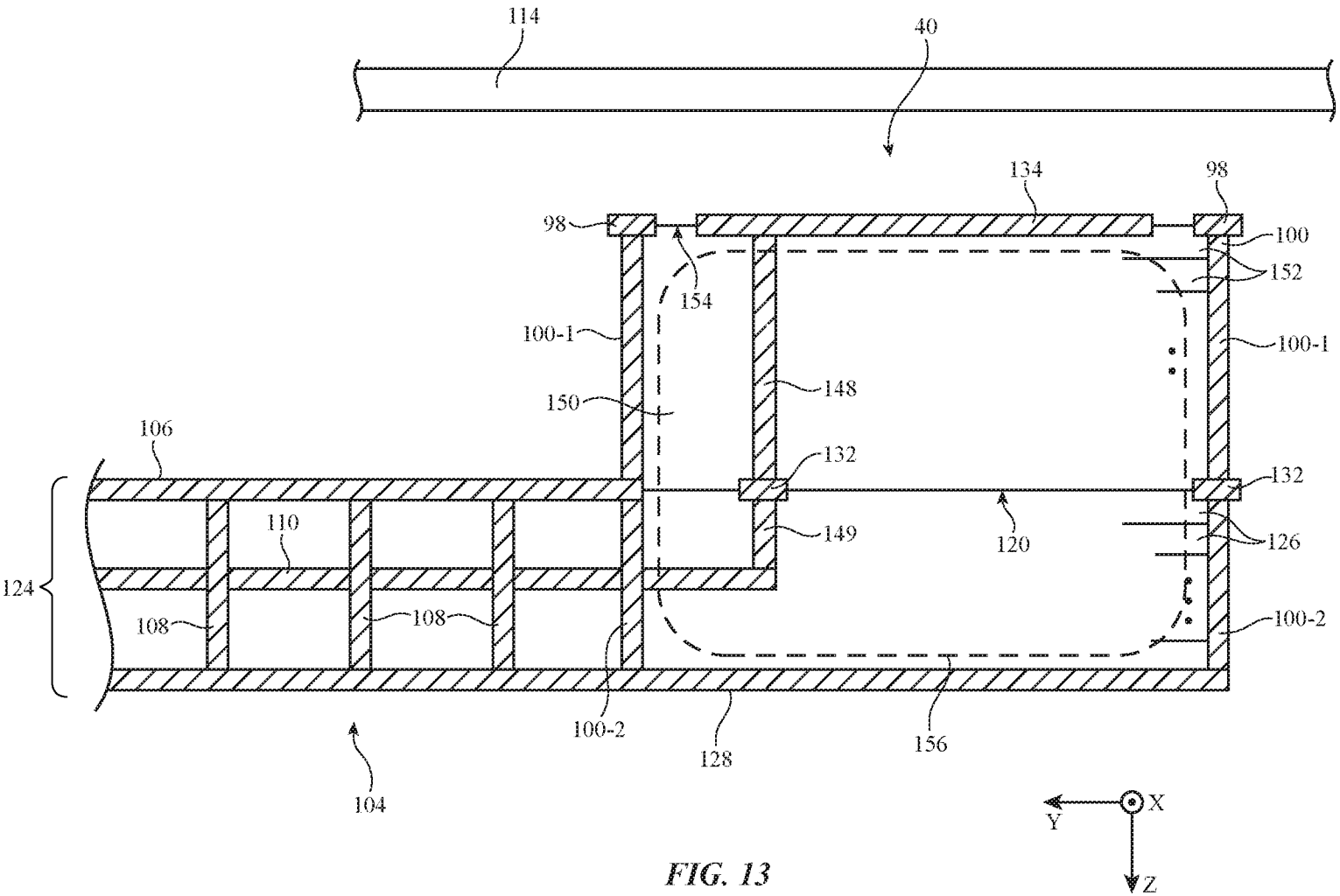
FIG. 13 is a cross-sectional side view of an illustrative dual-band patch antenna formed on a dielectric substrate mounted to a flexible printed circuit in accordance with some embodiments.

The dual-band patch antenna of FIG. 12 may be formed on a dielectric substrate that is mounted to an underlying flexible printed circuit, as shown in FIG. 13. FIG. 13 is a cross-sectional side view showing how antenna 40 (e.g., the dual-band patch antenna of FIG. 12) may be formed on a dielectric substrate mounted to an underlying flexible printed circuit such as flexible printed circuit 124.

As shown in FIG. 13, patch element 134 may be mounted to surface 154 of dielectric substrate 150. Dielectric substrate 150 may be formed from any desired dielectric materials such as epoxy, plastic, ceramic, glass, foam, polyimide, liquid crystal polymer, or other materials. In one suitable arrangement that is described herein as an example, dielectric substrate 150 is a ceramic substrate having stacked layers 152 of ceramic material. Dielectric substrate 150 may therefore sometimes be referred to herein as ceramic substrate 150. This example is merely illustrative and, if desired, one or more additional layers 152 of ceramic substrate 150 may be formed over surface 154 and patch element 134.

Ceramic substrate 150 may be mounted to surface 120 of flexible printed circuit 124. While ceramic substrate 150 is shown with a greater thickness (in the direction of the Z-axis) than flexible printed circuit 124 for the sake of clarity, flexible printed circuit 124 may be thicker than ceramic substrate 150. In one suitable arrangement, there may be a greater number of layers 126 than layers 152 in device 10. Ceramic substrate 150 may be mounted to surface 120 using surface-mount technology, solder, adhesive, screws, pins, clips, springs, and/or any other desired interconnect structures. In the example of FIG. 13, conductive interconnect structures 132 are used to couple conductive structures in ceramic substrate 150 to conductive structures in flexible printed circuit 124.

Conductive via 149 may extend from signal conductor traces 110 through flexible printed circuit 124 to conductive interconnect structures 132. Conductive via 148 may extend from conductive interconnect structures 132 through ceramic substrate 150 to patch element 134 (e.g., at positive antenna feed terminal 46 of FIG. 12). Grounded shielding ring 98 may be formed on surface 154 of ceramic substrate 150 and may surround the periphery of patch element 134 (e.g., in the X-Y plane of FIG. 13). Grounded shielding ring 98 may be shorted to ground plane 128 by conductive vias 100-1 and 100-2. Conductive vias 100-1 may extend from grounded shielding ring 98 through ceramic substrate 150 to conductive interconnect structures 132 and/or grounded traces 106 on flexible printed circuit 124. Conductive vias 100-2 may extend from conductive vias 100-1 through flexible printed circuit 124 to ground plane 128.

Conductive vias 100-1 and 100-2, patch element 134, and ground plane 128 may define a continuous antenna cavity (volume) 156 for antenna 40. The portion of surface 120 underlying patch element 134 may be free from grounded traces 106 to maximize the size of antenna cavity 156 (e.g., allowing antenna cavity 156 to extend downward to ground plane 128). In this way, antenna 40 may radiate within both the higher dielectric permittivity material of ceramic substrate 150 and the lower permittivity material of flexible printed circuit 124. This may serve to maximize bandwidth and efficiency for antenna 40. Flexible printed circuit 124 and antenna 40 may be mounted within device 10 adjacent to a dielectric cover layer such as dielectric cover layer 114.

The dual-band patch antenna of FIGS. 12 and 13 may support a greater number of polarizations than the dual-band planar inverted-F antenna of FIGS. 10 and 11. However, ceramic substrates such as ceramic substrate 150 of FIG. 13 may be more brittle and subject to tighter manufacturing tolerances than flexible printed circuit substrate 92 of FIGS. 10 and 11. The ceramic material used to form ceramic substrate 150 typically exhibits a greater dielectric constant (e.g., $d_k$~7-10) than the flexible printed circuit material used to form flexible printed circuit substrate 92 and flexible printed circuit 124 (e.g., $d_k$~3). Utilizing ceramic material to form ceramic substrate 150 may reduce the area occupied by antenna 40 of FIGS. 12 and 13 by as much as 33% or more relative to scenarios where flexible printed circuit material is used. This may help to compensate for the greater area required to implement patch antenna structures (which have dimensions on the order of half the wavelength of operation) than planer inverted-F antenna structures (which have dimensions on the order of one-quarter the wavelength of operation).

The examples of FIGS. 8-13 are merely illustrative. In general, antenna 40 may be formed using any desired antenna structures. Stripline 104 may be replaced with any desired radio-frequency transmission line structures. Multiple antennas 40 may be formed on the same flexible printed circuit 124.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a flexible printed circuit;

a dielectric substrate mounted to the flexible printed circuit;

an antenna resonating element having a low band arm and a high band arm formed from conductive traces on the dielectric substrate;

a first positive antenna feed terminal coupled to the low band arm;

a second positive antenna feed terminal coupled to the high band arm;

a ground plane on the flexible printed circuit;

a fence of conductive vias extending from the conductive traces through the dielectric substrate, into the flexible printed circuit, and to the ground plane, wherein the fence of conductive vias separates the low band arm from the high band arm.

2. The electronic device defined in claim 1, wherein the low band arm is configured to radiate in a first ultra-wideband communications band and the high band arm is configured to radiate in a second ultra-wideband communications band at higher frequencies than the first ultra-wideband communications band.

3. The electronic device defined in claim 2, wherein the first ultra-wideband communications band comprises a 6.5 GHz ultra-wideband communications band and the second ultra-wideband communications band comprises an 8.0 GHz ultra-wideband communications band.

4. The electronic device defined in claim 1, further comprising:

a stripline transmission line coupled to the first and second positive antenna feed terminals.

5. The electronic device defined in claim 1, further comprising:

a grounded shielding ring on the dielectric substrate and laterally surrounding the antenna resonating element.

6. The electronic device defined in claim 1, wherein the fence of conductive vias comprises:

first conductive vias extending from the antenna resonating element through the dielectric substrate to conductive interconnect structures on the flexible printed circuit; and second conductive vias extending from the conductive interconnect structures through the flexible printed circuit to the ground plane.

7. The electronic device defined in claim 6, further comprising:

a grounded shielding ring on the dielectric substrate and laterally surrounding the low band arm and the high band arm;

third conductive vias extending from the grounded shielding ring through the dielectric substrate; and fourth conductive vias extending from the third conductive vias through the flexible printed circuit to the ground plane.

8. The electronic device defined in claim 1, further comprising:

a radio-frequency transmission line having signal conductor traces on the flexible printed circuit;

first and second conductive vias extending from the signal conductor traces to the dielectric substrate;

a third conductive via extending from the first conductive via through the dielectric substrate to the first positive antenna feed terminal; and a fourth conductive via extending from the second conductive via through the dielectric substrate to the second positive antenna feed terminal.

9. The electronic device defined in claim 8, wherein the radio-frequency transmission line comprises a stripline, the stripline comprising:

grounded traces on the flexible printed circuit; and a portion of the ground plane, wherein a portion of the signal conductor traces is interposed between the grounded traces and the portion of the ground plane.

10. The electronic device defined in claim 1, wherein a volume that includes the dielectric substrate and a portion of the flexible printed circuit underlying the antenna resonating element are configured to form an antenna cavity for the antenna resonating element.

11. The electronic device defined in claim 10, wherein the dielectric substrate comprises a material selected from the group consisting of: polyimide and liquid crystal polymer.

12. An electronic device comprising:

a flexible printed circuit;

a dielectric substrate mounted to the flexible printed circuit;

a ground plane on the flexible printed circuit; and a planar inverted-F antenna that includes first and second resonating element arms formed from conductive traces on the dielectric substrate and that includes the ground plane, wherein the first resonating element arm is configured to handle radio-frequency signals in a first ultra-wideband communications band and the second resonating element arm is configured to handle radio-frequency signals in a second ultra-wideband communications band at higher frequencies than the first ultra-wideband communications band.

13. The electronic device defined in claim 12, further comprising:

a shielding ring on the dielectric substrate and laterally surrounding the first and second resonating element arms; and conductive vias that extend through the dielectric substrate and the flexible printed circuit and that couple the shielding ring to the ground plane.

14. The electronic device defined in claim 13, wherein the planar inverted-F antenna comprises a return path formed from additional conductive vias that extend from the conductive traces through the dielectric substrate and the flexible printed circuit to the ground plane.

15. The electronic device defined in claim 12, further comprising:

a radio-frequency transmission line having a signal conductor trace in the flexible printed circuit;

first and second conductive vias extending through the dielectric substrate; and third and fourth conductive vias extending through the flexible printed circuit, wherein the third conductive via couples the signal conductor trace to the first conductive via, the first conductive via couples the third conductive via to the first resonating element arm, the fourth conductive via couples the signal conductor trace to the second conducive via, and the second conductive via couples the fourth conductive via to the second resonating element arm.

16. The electronic device defined in claim 12, wherein the dielectric substrate comprises a flexible printed circuit substrate.

17. The electronic device defined in claim 12, further comprising:

a first radio-frequency transmission line on the flexible printed circuit that is configured to convey the radio-frequency signals in the first and second ultra-wideband communications bands for the planar inverted-F antenna;

a second radio-frequency transmission line on the flexible printed circuit that is configured to convey radio-frequency signals in a wireless local area network frequency band;

a third radio-frequency transmission line on the flexible printed circuit that is configured to convey radio-frequency signals in a cellular telephone frequency band;

a first radio-frequency connector on the flexible printed circuit that is coupled to the first radio-frequency transmission line;

a second radio-frequency connector on the flexible printed circuit that is coupled to the second radio-frequency transmission line; and a third radio-frequency connector on the flexible printed circuit that is coupled to the third radio-frequency transmission line.

18. Apparatus comprising:

a flexible printed circuit;

a ground plane on the flexible printed circuit;

a dielectric substrate mounted to the flexible printed circuit;

an antenna having a planar element formed from a conductive trace on the dielectric substrate;

a radio-frequency transmission line in the flexible printed circuit and having a signal conductor trace coupled to the planar element through the flexible printed circuit and the dielectric substrate;

a ring of conductive traces on the dielectric substrate that laterally surrounds the planar element; and fences of conductive vias extending from the ring of conductive traces through the dielectric substrate and the flexible printed circuit to the ground plane, wherein the fences of conductive vias, the ground plane, and the planar element define an antenna cavity for the antenna, the antenna cavity comprising the dielectric substrate and a portion of the flexible printed circuit extending from the dielectric substrate to the ground plane.

19. The apparatus defined in claim 18, wherein the planar element has a first length associated with conveying the radio-frequency signals in the first ultra-wideband communications band and has a second length associated with conveying the radio-frequency signals in the second ultra-wideband communications band.

* * * * *